US012037797B2

(12) United States Patent
Matuszewski

(10) Patent No.: US 12,037,797 B2
(45) **Date of Patent: *Jul. 16, 2024**

(54) FLASHING APPARATUS OR DRIP CAP WATER MANAGEMENT DEVICE AND SYSTEM

(71) Applicant: LOUISIANA-PACIFIC CORPORATION, Nashville, TN (US)

(72) Inventor: Aaron Matuszewski, Green Bay, WI (US)

(73) Assignee: LOUISIANA-PACIFIC CORPORATION, Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/487,065

(22) Filed: Sep. 28, 2021

(65) Prior Publication Data

US 2022/0010561 A1 Jan. 13, 2022

Related U.S. Application Data

(63) Continuation of application No. 17/020,892, filed on Sep. 15, 2020, now Pat. No. 11,131,098.

(60) Provisional application No. 63/040,116, filed on Jun. 17, 2020.

(51) Int. Cl.
*E04F 13/08* (2006.01)

(52) U.S. Cl.
CPC ..... *E04F 13/0898* (2013.01)

(58) Field of Classification Search
CPC ..... E04F 13/0864; E04F 13/0889; E04F 21/1855; E04F 13/0898; E04F 19/061; E04B 1/64
See application file for complete search history.

(56) References Cited

U.S. PATENT DOCUMENTS 1,379,516 A * 5/1921 Benjamin ..... E04B 1/62 105/396
2,292,984 A * 8/1942 Alvarez, Jr. ..... E04F 13/0803 52/471
2,293,744 A * 8/1942 Miles ..... E04F 13/0837 52/553

(Continued)

*Primary Examiner* — Rodney Mintz
(74) *Attorney, Agent, or Firm* — Wayne Edward Ramage; Baker Donelson

(57) ABSTRACT

An improved flashing system and apparatus. A flashing apparatus or drip cap is attached to the back side or an edge of a panel or board, and has a short angled front section and edge extending over the front side of the panel or board. The flashing apparatus or drip cap may comprise a single piece of metal, or other suitable materials, including but not limited to plastic, formed by folding or by stamping or molding. The back of the drip cap has a first back section extending over the back side of an adjacent panel or board, and also may have a second back section extending over the back side of the panel or board. The flashing apparatus or drip cap may be attached by glue or other adhesive means. The second back section, if present, may be attached to the back of the panel or board by fastening means known in the art, such as, but not limited to, staples or nails that penetrate only the lower section and the back of the panel or board. The flashing apparatus or drip cap prevents water and moisture from penetrating behind the panel or board after installation.

12 Claims, 11 Drawing Sheets

(56) References Cited

U.S. PATENT DOCUMENTS 3,818,668 A * 6/1974 Charniga ..... E04F 13/0864 52/553
4,155,175 A * 5/1979 Stiles ..... E04F 21/1855 33/646
4,425,714 A * 1/1984 Kelly, Jr. ..... E04F 21/1855 33/646
4,485,600 A * 12/1984 Olson ..... E04F 13/10 52/62
4,698,942 A * 10/1987 Swartz ..... E04F 13/0864 52/99
5,586,415 A * 12/1996 Fisher ..... E06B 1/62 52/61
5,884,435 A * 3/1999 David ..... E04F 19/061 52/302.6
6,052,961 A * 4/2000 Gibbs ..... E04D 1/365 52/518
6,301,849 B1 * 10/2001 Roth ..... A01M 1/026 52/302.1
7,434,329 B2 * 10/2008 Walda ..... E04F 21/1855 52/794.1
7,490,447 B2 * 2/2009 Ouellette ..... E04F 21/1855 33/645
7,584,587 B2 * 9/2009 Ouellette ..... E04F 13/0889 52/749.1
7,721,488 B1 * 5/2010 Bennett ..... E04F 13/0864 52/302.6
7,784,222 B2 * 8/2010 Bennett ..... E04F 13/0864 52/518
7,836,652 B2 * 11/2010 Futterman ..... E04F 13/02 52/459
8,448,401 B2 * 5/2013 Schaefer ..... E04F 13/0864 52/460
9,458,624 B2 * 10/2016 Colyn ..... E04F 13/0803
9,624,675 B2 * 4/2017 Schaefer ..... E04F 13/0837
9,951,514 B2 * 4/2018 Debuff ..... E04F 19/00
10,202,757 B2 * 2/2019 Kadavy ..... E04F 13/0898
10,301,816 B2 * 5/2019 DeBuff ..... E04F 13/0887
10,544,578 B2 * 1/2020 DeBuff ..... E04F 13/148
10,900,221 B2 * 1/2021 McEndree ..... E04F 21/1855
11,131,098 B1 * 9/2021 Matuszewski ..... E04F 13/0898
2002/0023366 A1 * 2/2002 Bueno ..... E04D 1/34 33/647
2002/0174618 A1 * 11/2002 Carroll ..... E04F 21/1855 52/549
2004/0237443 A1 * 12/2004 Haley ..... E04F 13/0864 52/96
2005/0262792 A1 * 12/2005 Walda ..... E04F 21/1855 52/547
2006/0269713 A1 * 11/2006 Zuege ..... B32B 25/18 428/40.1
2006/0272258 A1 * 12/2006 Pollock ..... E04F 21/1855 52/543
2007/0054086 A1 * 3/2007 Pagel ..... E04B 1/003 428/106
2007/0055007 A1 * 3/2007 Pagel ..... E04B 1/003 524/569
2007/0068115 A1 * 3/2007 Ouellette ..... E04F 21/1855 52/749.1
2007/0157528 A1 * 7/2007 Gawoski ..... E06B 1/62 52/58
2008/0008880 A1 * 1/2008 Walda ..... E04F 13/0889 428/343
2008/0209834 A1 * 9/2008 Ouellette ..... E04F 13/0889 52/518
2008/0209851 A1 * 9/2008 Ouellette ..... E04F 13/0889 52/749.1
2008/0318019 A1 * 12/2008 Walda ..... E04F 13/0889 428/220
2009/0056235 A1 * 3/2009 Morsching ..... E04F 19/064 52/741.1
2009/0064599 A1 * 3/2009 Bennett ..... E04F 13/0864 52/60
2010/0218434 A1 * 9/2010 Bennett ..... E04F 13/0864 52/302.6
2011/0163510 A1 * 7/2011 Wedi ..... E04F 19/061 156/60
2012/0042604 A1 * 2/2012 Walda ..... E04F 21/1855 52/741.4
2012/0047837 A1 * 3/2012 Schaefer ..... E04F 13/148 52/519
2014/0208679 A1 * 7/2014 Schaefer ..... E04F 13/0832 52/748.11
2016/0040435 A1 * 2/2016 Schaefer ..... E04F 13/0864 52/704
2016/0160497 A1 * 6/2016 Randlett ..... E04B 2/42 52/61
2017/0081840 A1 * 3/2017 DeBuff ..... E04F 19/00
2018/0038096 A1 * 2/2018 Kadavy ..... E04B 1/70
2018/0127974 A1 * 5/2018 DeBuff ..... E04F 19/00
2018/0216340 A1 * 8/2018 DeBuff ..... E04F 13/148
2020/0199865 A1 * 6/2020 McEndree ..... E04F 21/1855

* cited by examiner

FLASHING APPARATUS OR DRIP CAP WATER MANAGEMENT DEVICE AND SYSTEM

This application is a continuation of U.S. patent application Ser. No. 17/020,892, filed Sep. 15, 2020, which claims benefit of and priority to U.S. Provisional App. No. 63/040,116, filed Jun. 17, 2020, both of which are incorporated herein in their entireties by specific reference for all purposes.

FIELD OF INVENTION

This invention relates to an improved flashing system and apparatus for preventing water penetration behind a siding panel or board.

SUMMARY OF INVENTION

In various exemplary embodiments, the present invention comprises an improved flashing system and apparatus. In several embodiments, the apparatus comprises a drip cap that is attached to the back side of a panel or board, and extends across the top thereof with a short angled drip edge extending downwards on the front side of the panel or board. The drip cap may comprise a single piece of metal (or other suitable materials, including but not limited to plastic) formed by folding or by stamping or molding. The drip cap extends longitudinally along some or all of the top of the panel or board. In some embodiments, the drip cap may extend beyond one or both ends of the panel or board.

In general configuration, the back of the drip cap comprises an upper section upward away from the top of the panel or board. It also may comprise a lower section extending downward. The lower section, if present, may be attached to the back of the panel or board by fastening means known in the art, such as, but not limited to, staples or nails. The upper section may comprise a single-thickness section (i.e., same thickness as the lower section), or, if formed by folding, a double-thickness section. A flat or slightly angled section extends horizontally (or at a small angle from the horizontal) across the top of the panel or board, and may be attached thereto, with a drip edge or lip extending downward at the front.

The present apparatus thus sits above and behind the siding panel or board, extends through the seam at the top of the siding panel or board, thereby preventing water from entering through the seam. The configuration of the apparatus causes water to be more inclined to flow toward the front side, and the drip edge causes water to fall from the apparatus at a lower point so as to prevent water from penetrating the seam under the apparatus.

DETAILED DESCRIPTION OF EXEMPLARY EMBODIMENTS

Figure 1:
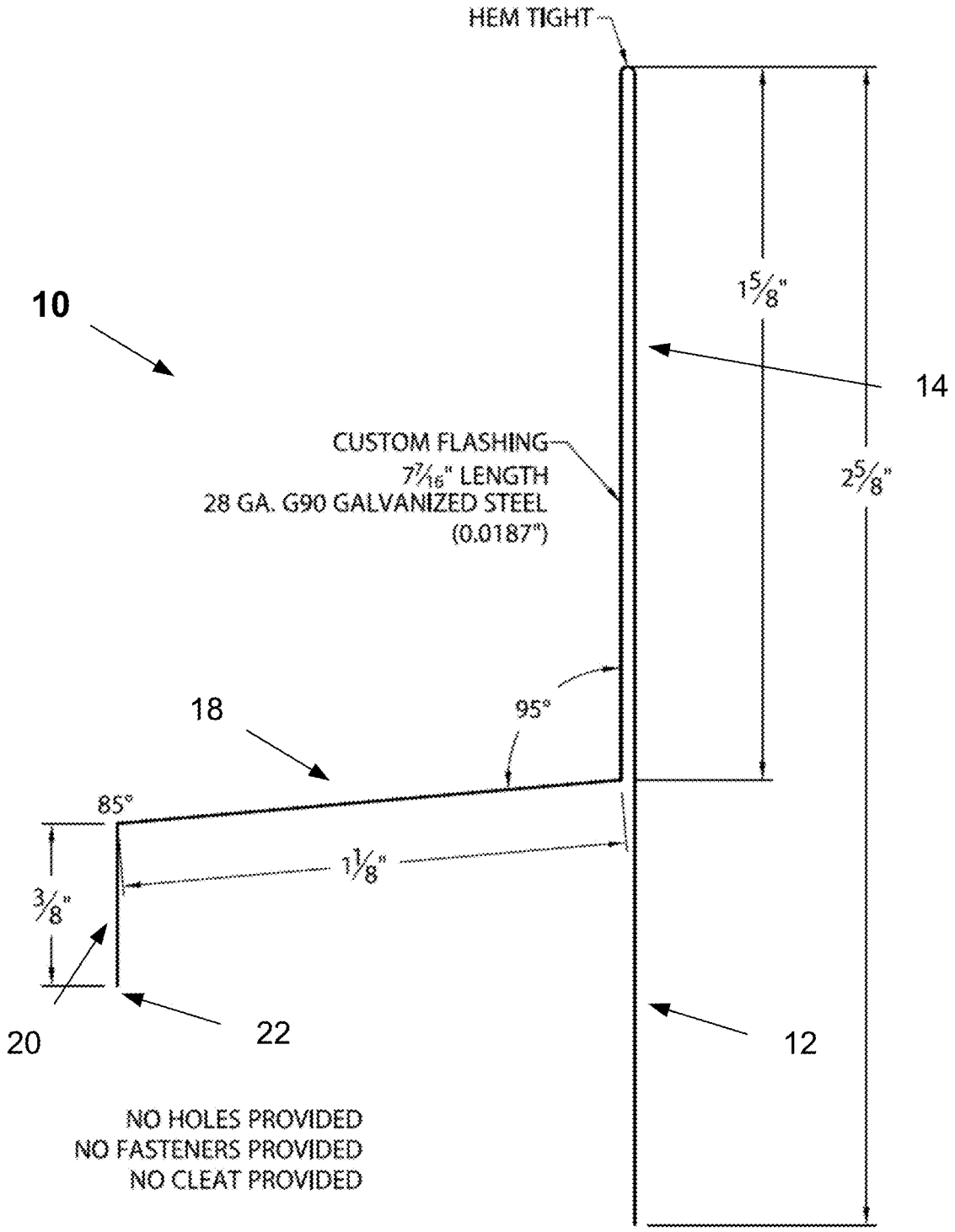
FIG. 1 shows a side view of an exemplary embodiment of a drip cap flashing device in accordance with an exemplary embodiment of the present invention.
Figure 2:
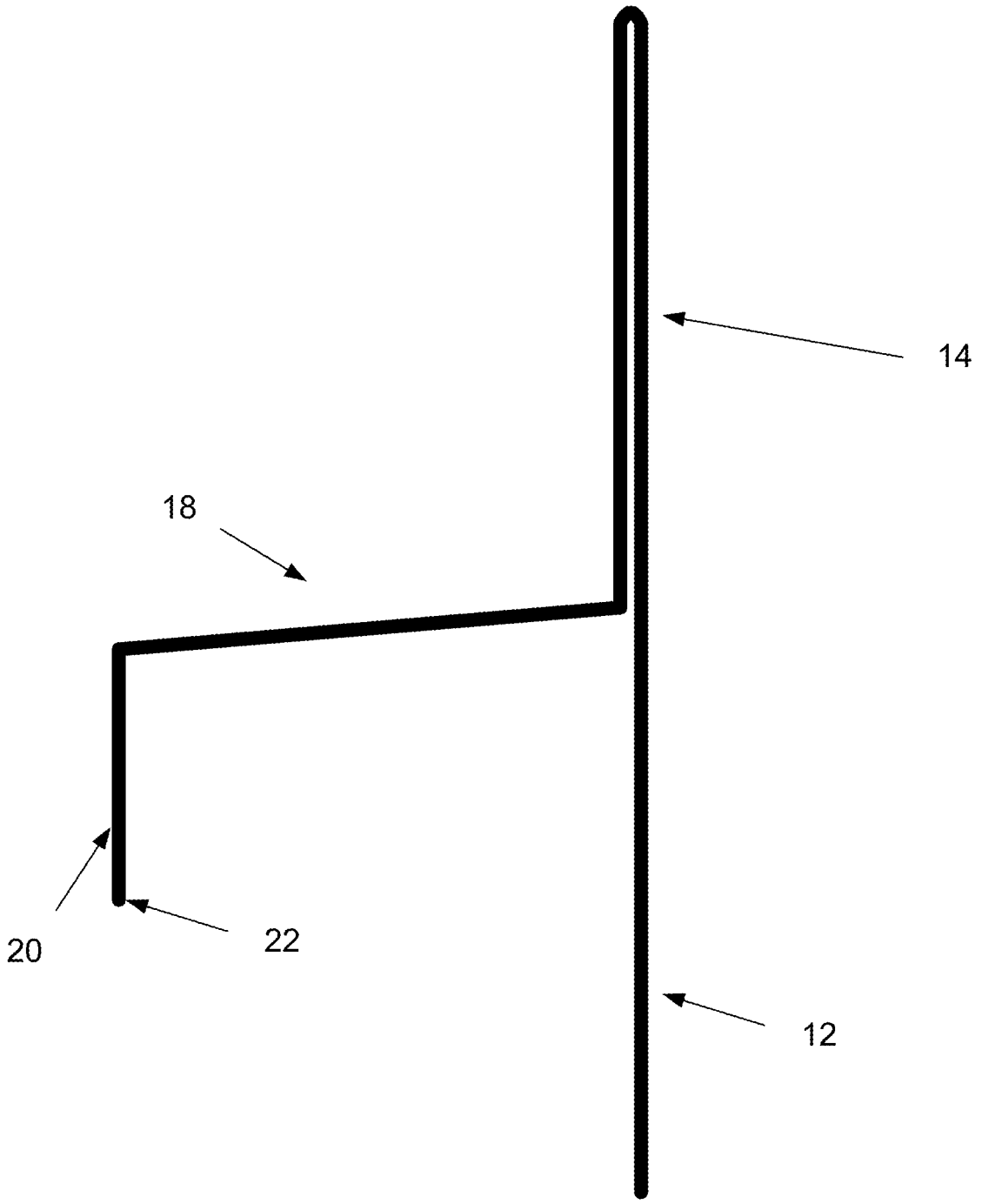
FIG. 2 shows a side view of another exemplary embodiment of the drip cap flashing device.
Figure 3:
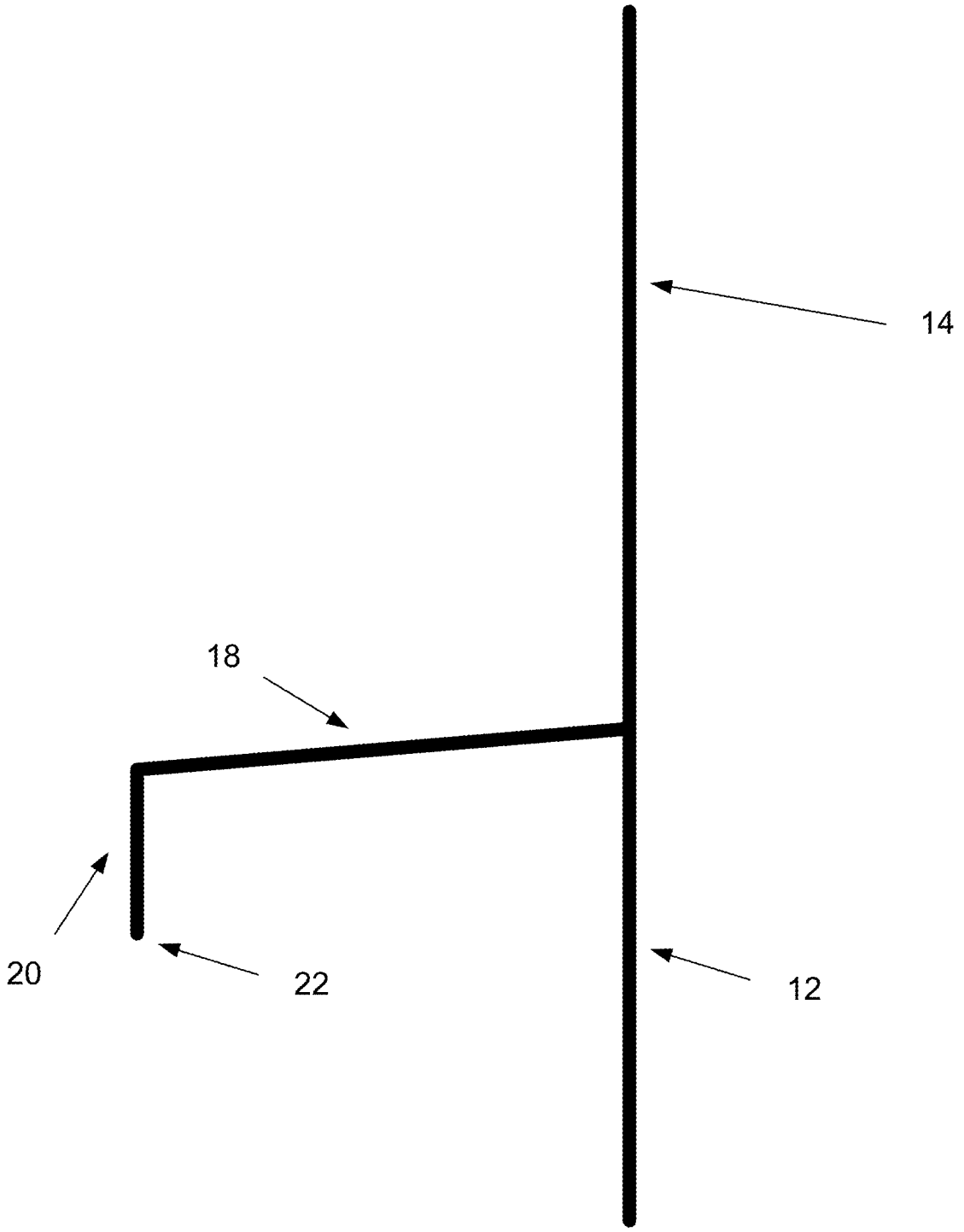
FIG. 3 shows a side view of another exemplary embodiment of the drip cap flashing device.
Figure 4:
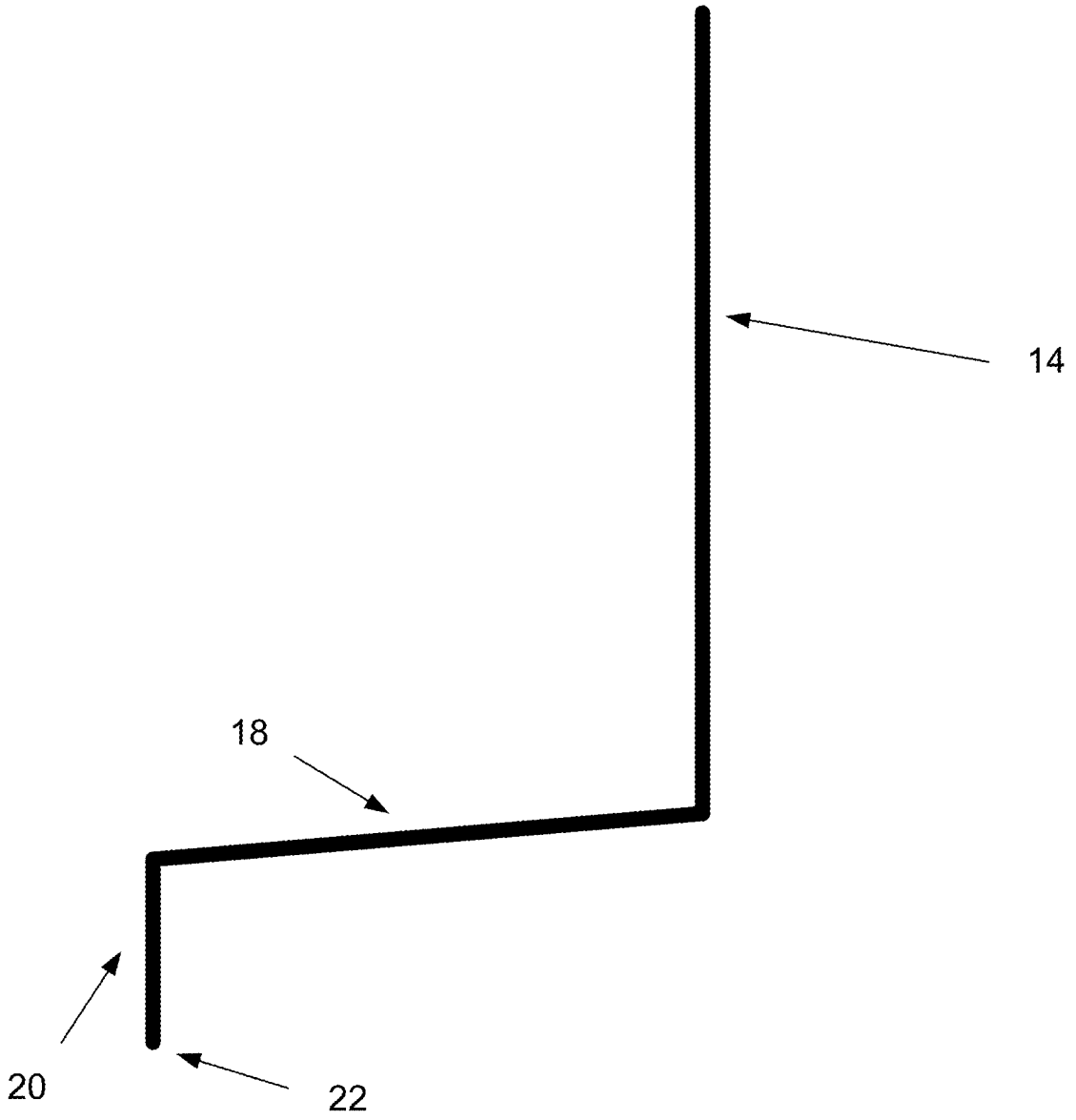
FIG. 4 shows a side view of another exemplary embodiment of the drip cap flashing device.
Figure 5:
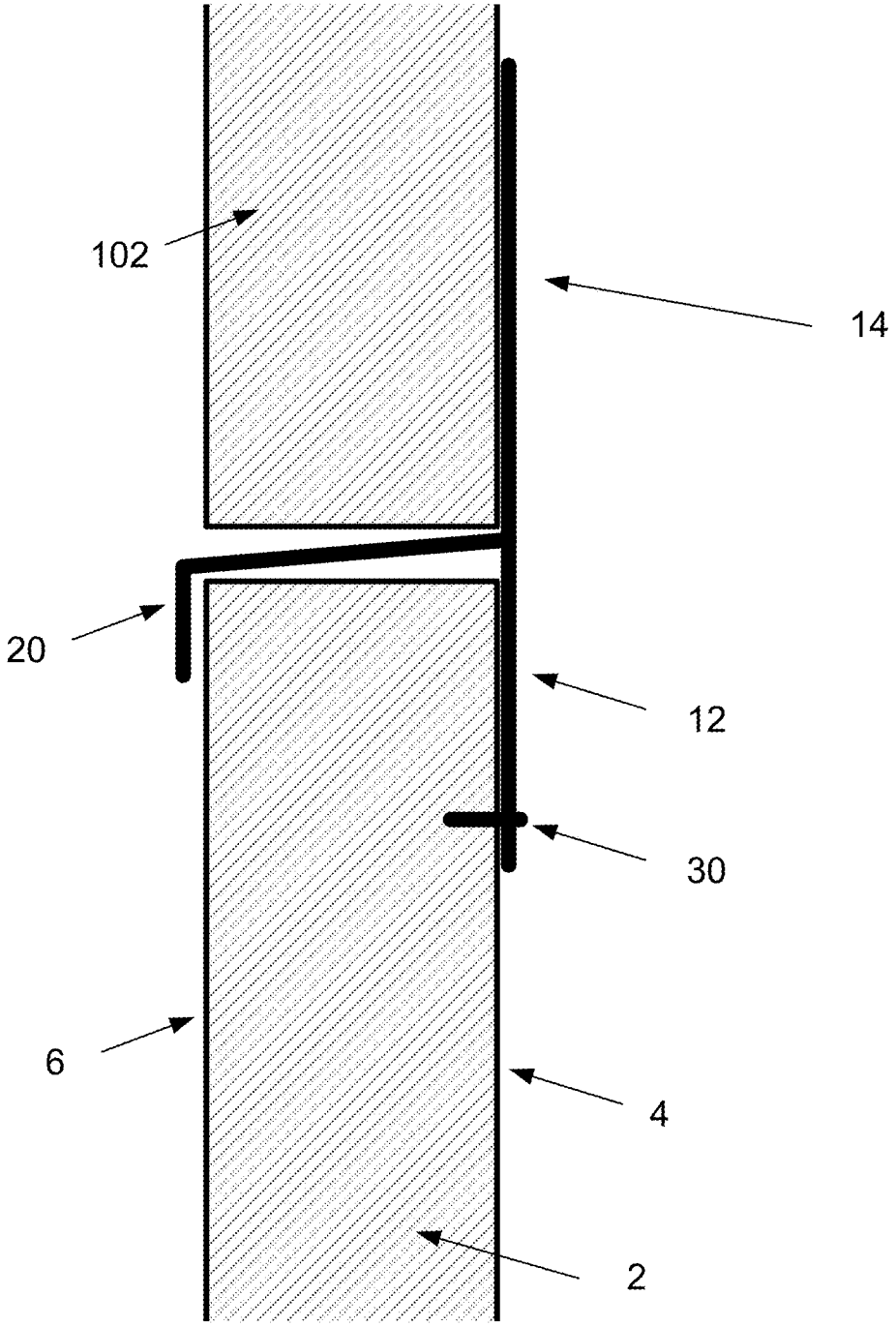
FIG. 5 shows a side cutaway view of the drip cap flashing device of FIG. 3 in position between a siding board and a higher framing component or siding board.
Figure 6:
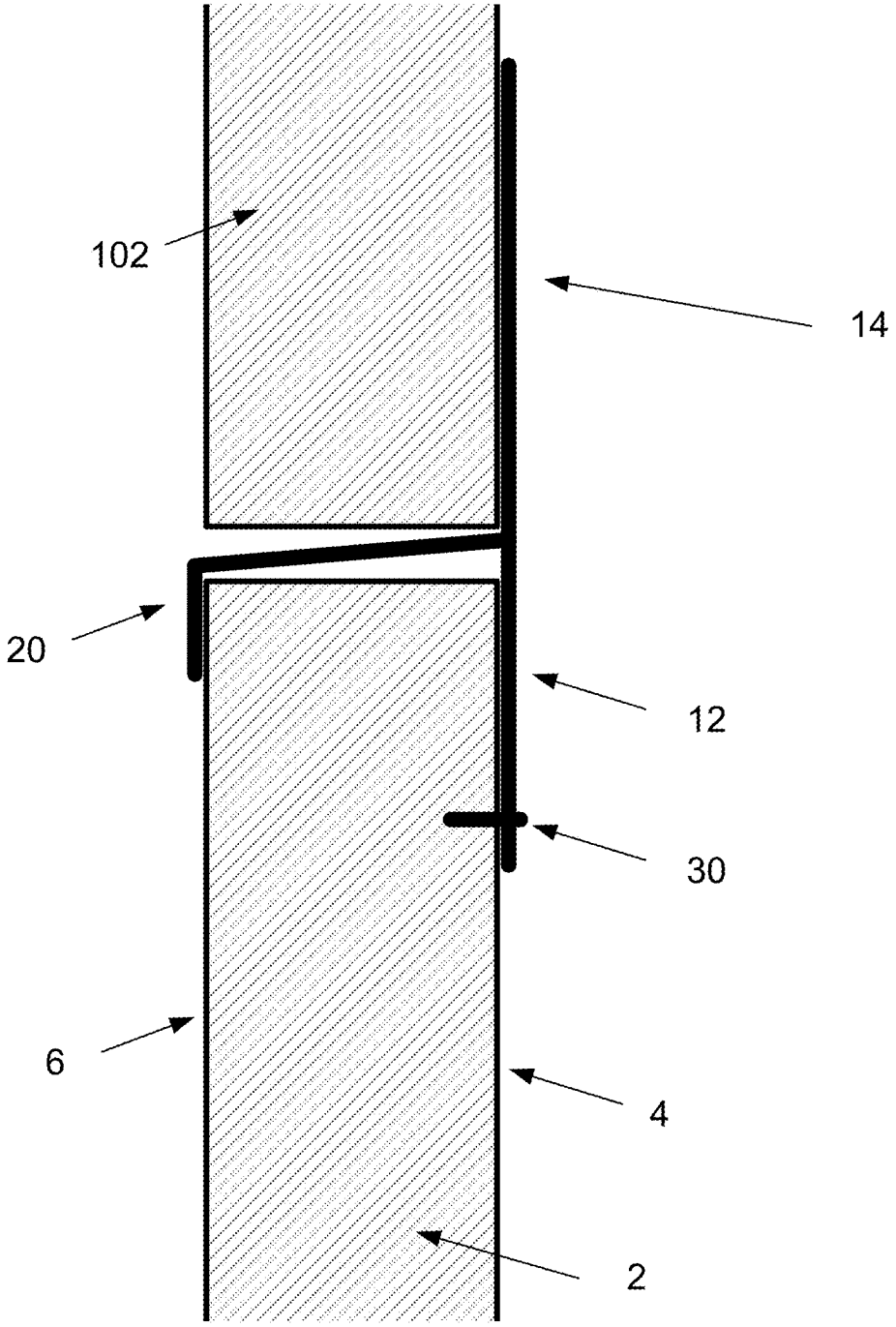
FIG. 6 shows a side cutaway view of FIG. 5 with the length of the top set so the front drip section of the drip cap flashing device is closer or in contact with the front of the siding board.
Figure 7:
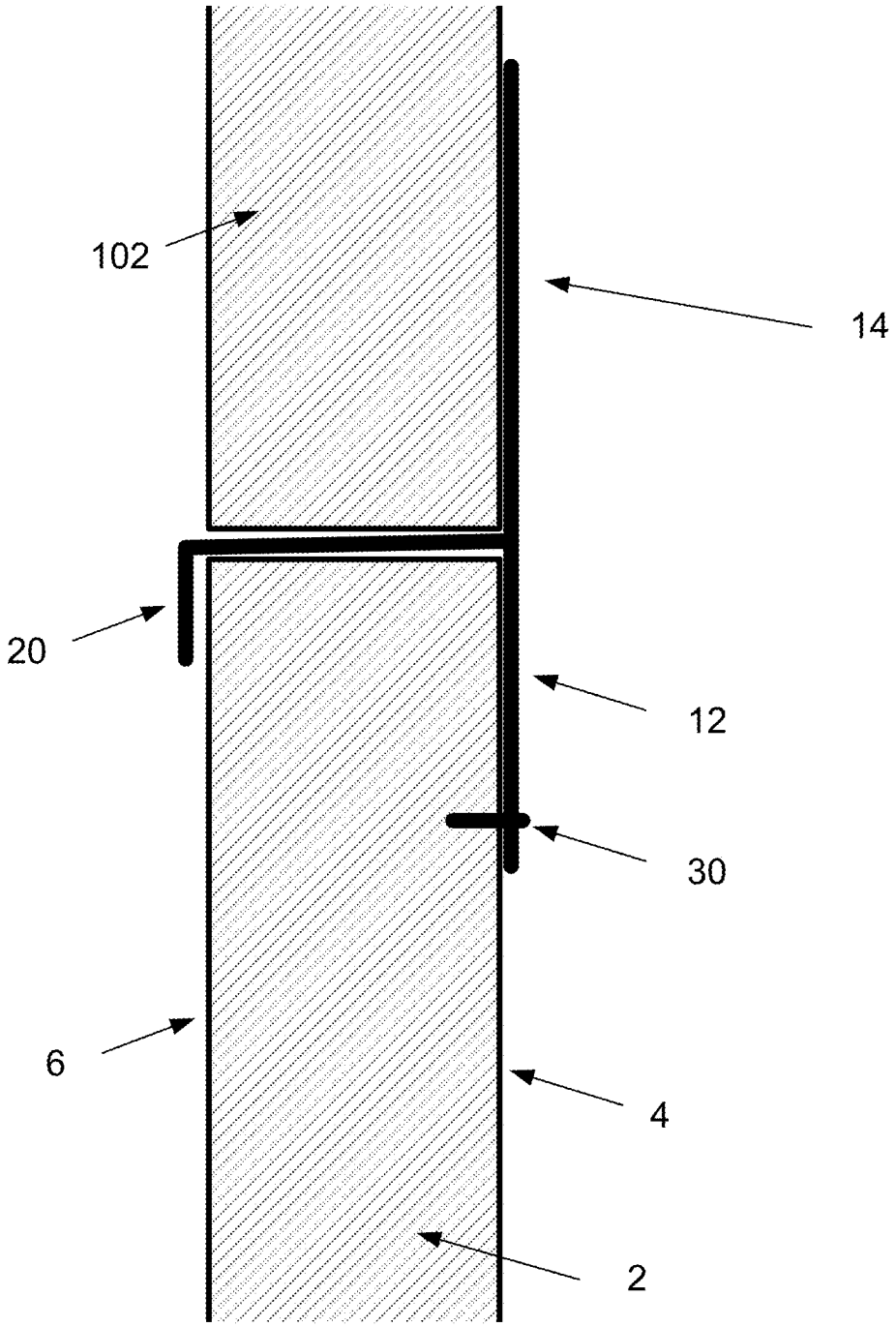
FIG. 7 shows a side cutaway view of FIG. 5 with the top of the drip cap flashing device set at a near-orthogonal angle.
Figure 8:
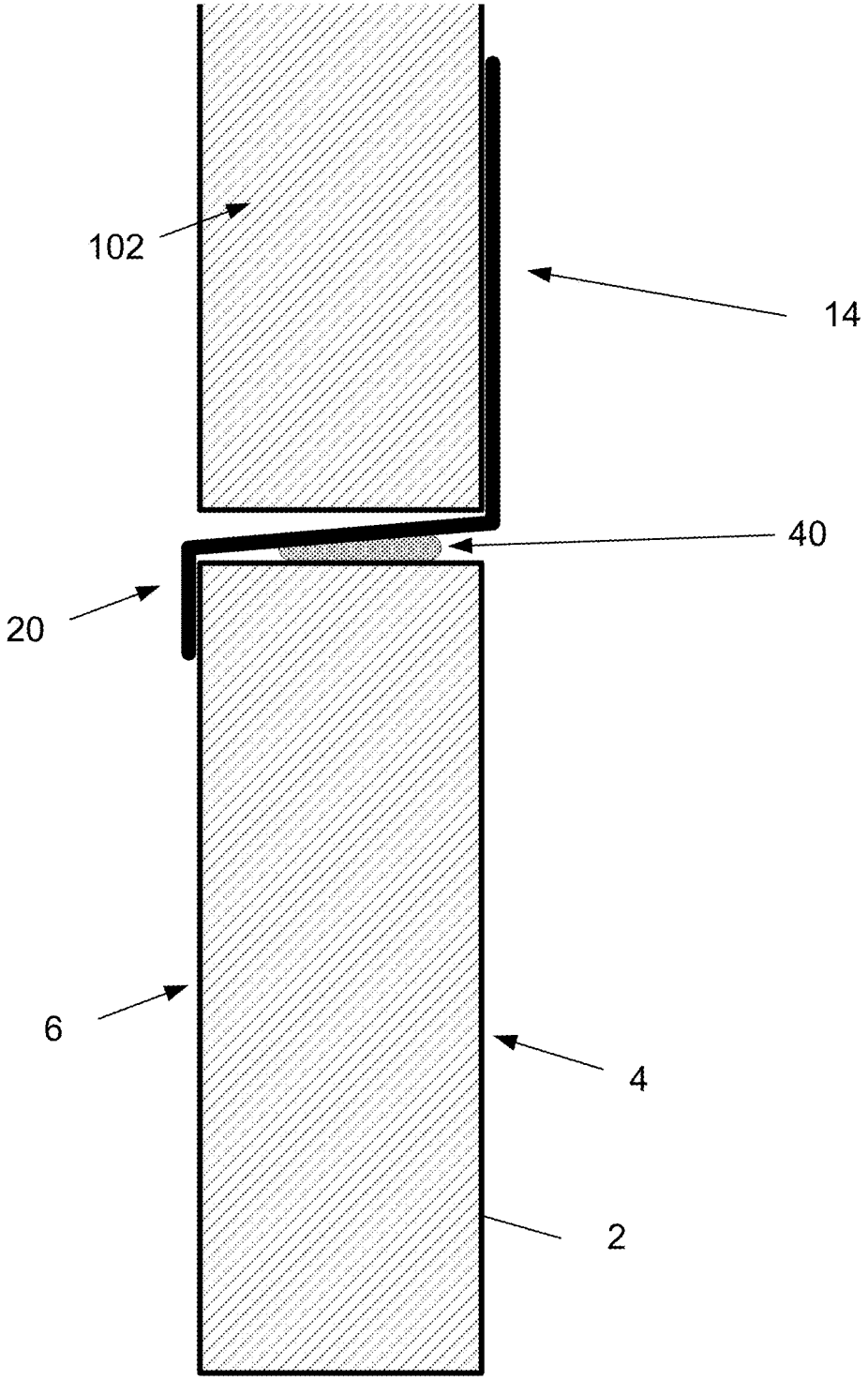
FIG. 8 shows a side cutaway view of the drip cap flashing device of FIG. 4 in position between a siding board and a higher framing component or siding board.
Figure 9:
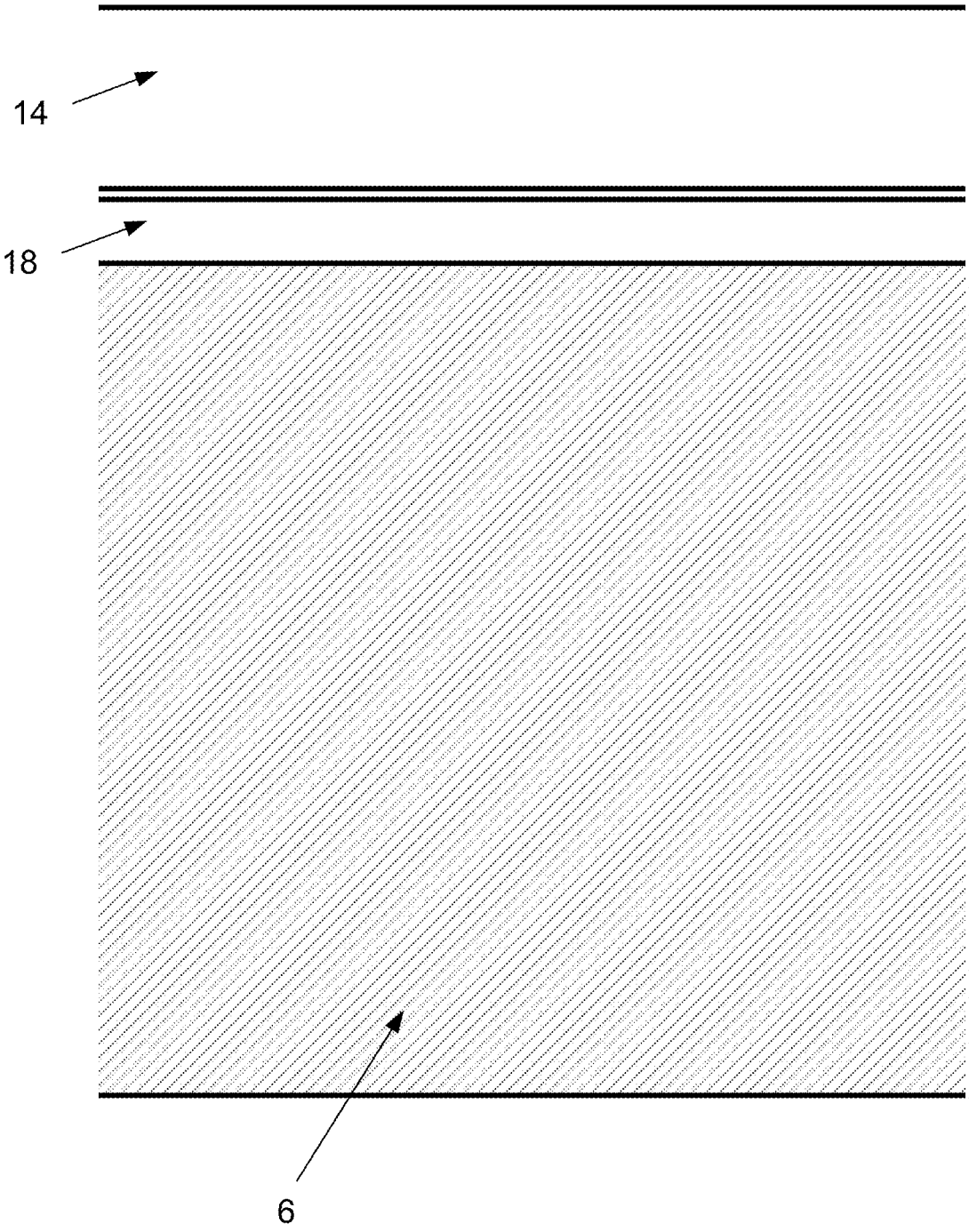
FIG. 9 shows a front view of a section of siding board with the drip cap flashing device installed on top.
Figure 10:
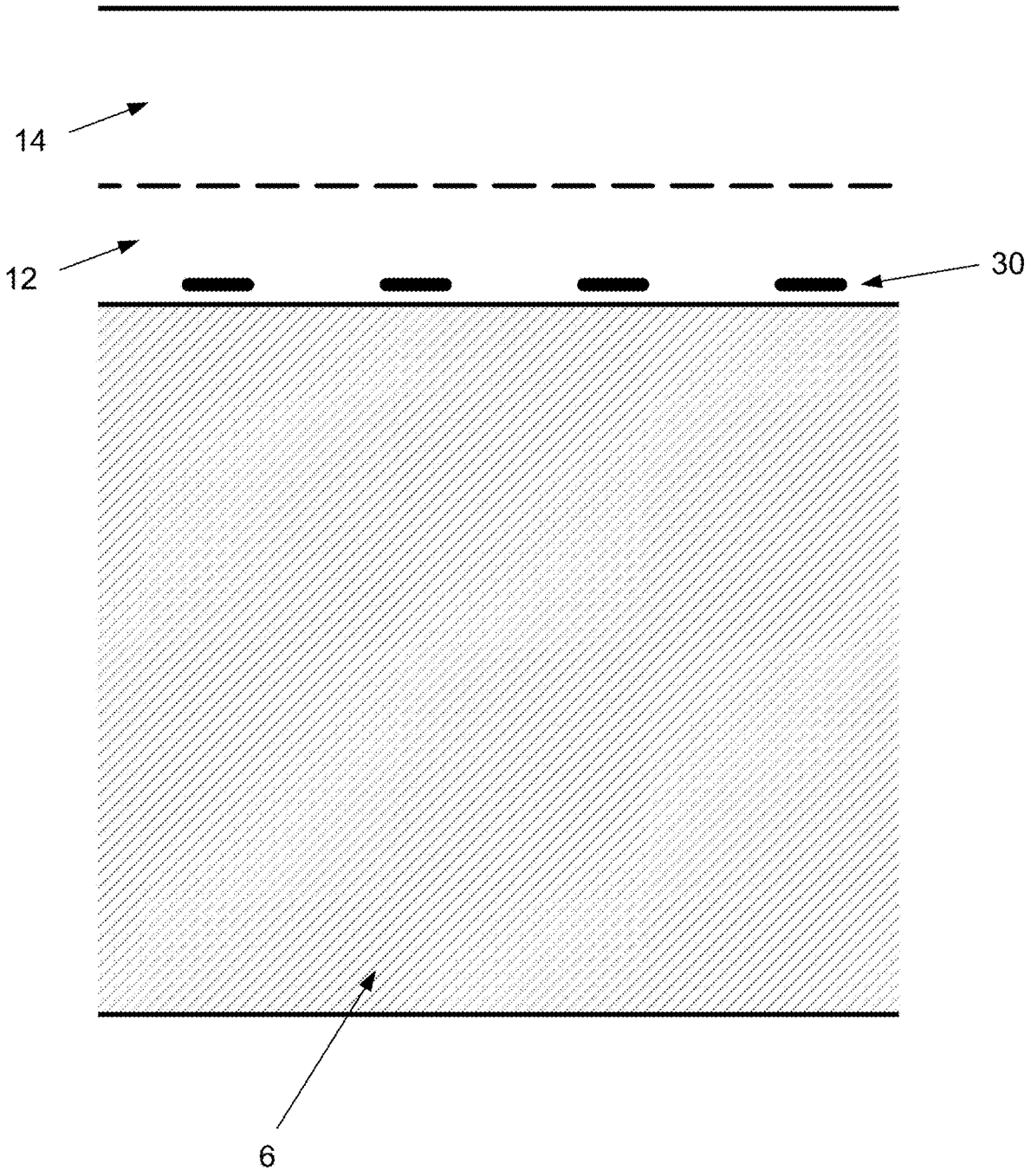
FIG. 10 shows a back view of FIG. 8 using the drip cap flashing device of FIG. 2 or 3.
Figure 11:
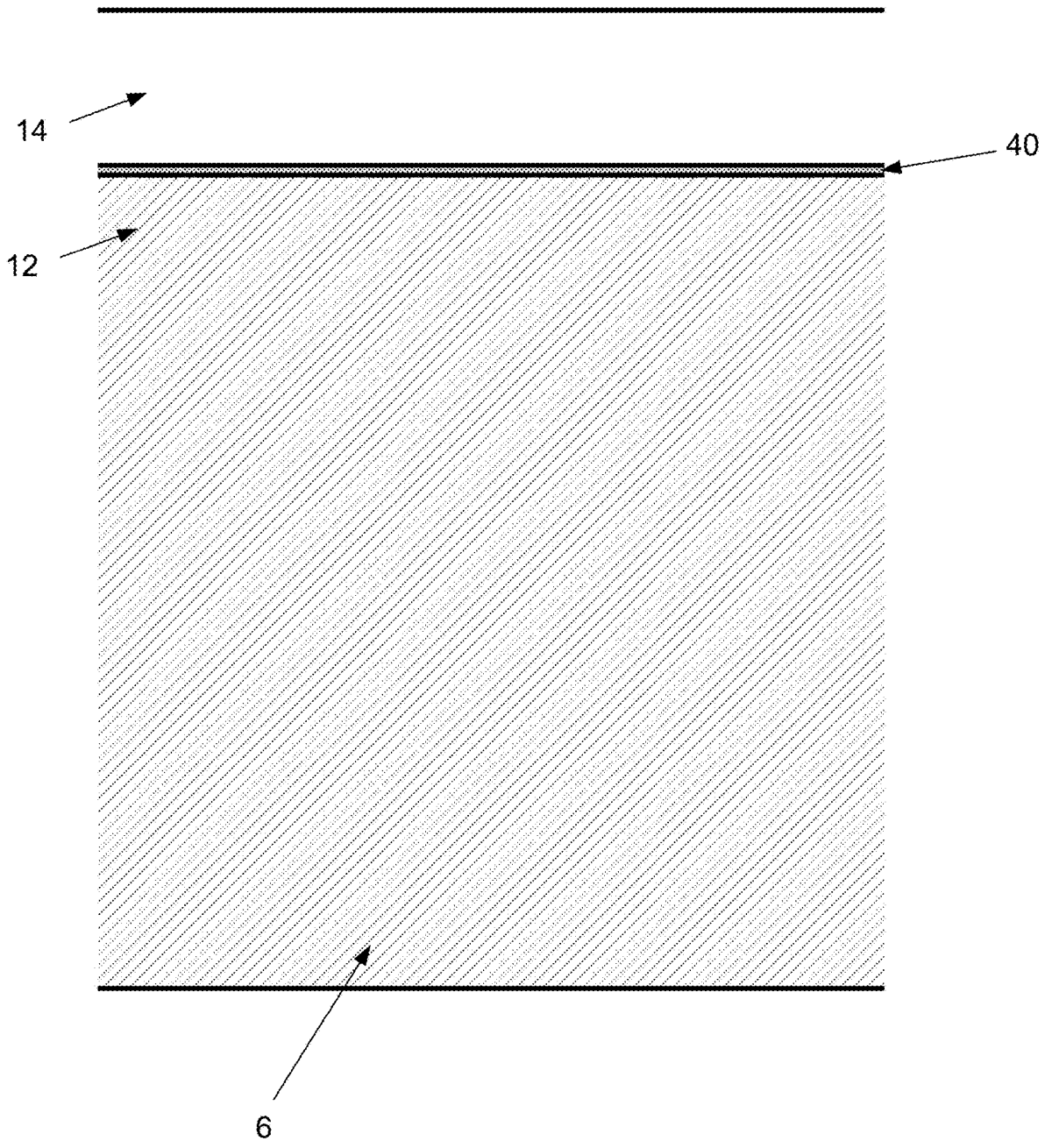
FIG. 11 shows a back view of FIG. 8 using the drip cap flashing device of FIG. 4.

In various exemplary embodiments, the present invention comprises an improved flashing system and apparatus. As seen in FIGS. 1-11, the apparatus comprises a drip cap 10 that is attached to the back side 4 of a panel or board 2, and extends across the top 8 of the panel or board with a short angled drip section 20 and edge 22 extending downwards on the front side 6 of the panel or board 2. The drip cap 10 may comprise a single piece of metal (or other suitable materials, including but not limited to galvanized steep, plastic, or the like) formed by folding (as seen in FIGS. 1, 2 and 4) or by stamping or molding (as seen in FIG. 3). The drip cap 10 extends longitudinally along some or all of the top 8 of the panel or board 2. In some embodiments, the drip cap may extend beyond one or both ends of the panel or board 2.

In the configuration seen in FIGS. 1-4, the back of the drip cap 10 comprises an upper section 14 upward away from and behind the top 8 of the panel or board 2. It also may comprise a lower section 12 extending downward, as seen in FIGS. 1-3. Where present, the lower section 12 may be attached to the back 4 of the panel or board 2 by fastening means 30 known in the art, such as, but not limited to, staples or nails (applied manually with a staple or nail gun, or by hammering) that penetrate the lower section and the back of the panel or board. Alternatively, or in addition, the drip cap may be attached to the top 8 and/or other portions of the panel or board by glue or other form of adhesive 40. As seen in FIG. 4, the flat or slightly angled top section 18 may be affixed to the top 8 of the panel by a line of glue or other adhesive means, although glue or other adhesive means may be applied in other locations as well.

In several embodiments, the height of the upper section 14 may be substantially greater than the height of the drip section 20 and/or the height of the lower section 12, if the latter is present. The height of the upper section helps prevent water or moisture from penetrating behind the upper section. Similarly, this also may help the lower section, where present, remain secure relatively tight against the back 4 of the panel. In alternative embodiments, the upper section and the lower section, when present, may be more equal in height. In several embodiments, the drip section is shorter in height than the lower section, although they also may be equal or roughly equal in height, and in some embodiments, the drip section may be greater in height than the lower section.

In certain embodiments, the apparatus has no initial holes or penetrations. Fasteners or cleats also may not be provided. There are no penetrations other than those associated with the penetrating fastening means 30, if used, and thus no penetrations other than in the lower section attached to the back of the panel or board. That is, there are no penetrations in the drip section, top section, or upper section. In various embodiments, the apparatus is thus not attached to any upper wall or framing element or siding panel or board, and is attached only to the back, top, or other portion of the panel or board on which it sits. Accordingly, in alternative embodiments where no lower section is present, there may be no penetrations, with the apparatus affixed to the panel or board on which it sits by glue or other adhesive means 40.

The upper section 14 may comprise a single-thickness section (i.e., same thickness as the lower section), as seen in FIG. 3, or, if formed by folding, a double-thickness section, as seen in FIGS. 1-2. A flat or slightly angled top section 18 extends horizontally (or at a small angle from the horizontal, with the angle sloping downwards from the back to the front) across the top of the panel or board, with a drip section 20 with a lower edge or lip 22 extending downward at the front. The top section 18 may be of a length or width slightly larger than the width or thickness of the panel or board 2, so that the drip section 20 is closer to or in contact with the front 6. In alternative embodiments, the top section 18 is longer or greater in width so that the drip section 20 is slightly further away from the front 6 and is not in contact with the front 6.

As seen in FIG. 5-8, the present apparatus thus sits behind the siding panel or board, extends through the seam at or across the top of the siding panel or board (such as may be formed by placement of the siding panel or board 2 proximate to a higher wall or framing component or element or a higher or upper siding panel or board 102), thereby preventing water from entering through the seam. The configuration of the apparatus causes water to flow toward the front side, and the drip edge causes water to fall from the apparatus at a lower point so as to prevent water from wicking up behind the drip section or otherwise penetrating the seam under the apparatus.

More particularly, the configuration of the top section and drip section, including any angles therein, promote the flow of any moisture or bulk water from the back towards the front and downward, thereby limiting water access and/or accumulation behind the back and in the seams of the boards/panels. The configuration of the drip edge ensures that water continues to flow down the outward-facing front of the panel/board, and cannot seep or flow behind the drip or top sections. Likewise, any penetrations for attachment of the drip cap to the panel/board are limited to the protected lower back section, if present, so that any water seeking to enter a seam from the front, or any water flowing down behind a higher panel/board, is directed by the drip cap through the seam towards the front and down the front section, with no opportunity for the water to seep or leak through any penetrations. The upper back section extending upward prevents water entering the seam from the front from rising up and over the back section. As discussed above, the upper back section is not attached to the higher panel/board, and thus there are no penetrations that would allow water to seep or leak through the drip cap to get behind the boards/panels.

In several embodiments, the drip cap apparatus is installed on the board or panel at a primary or second manufacturing facility, or otherwise, prior to shipping to a building location for installation. This increases efficiency in the field at the job-site or point of installation, as the drip cap apparatus is affixed to each panel in a controlled environment, not in the field.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A flashing system for building construction, comprising:

a first board or panel with a front side, a back side, and a first edge;

a second board or panel with a front side, a back side, and a second edge, wherein the first edge of the first board or panel is positioned adjacent to the second edge of the second board or panel to form a seam therebetween;

a flashing apparatus positioned in the seam, said flashing apparatus comprising:

a front section configured to extend a first distance over a portion of the front side of the first board or panel;

a first back section configured to extend a second distance over a portion of the back side of the second board or panel;

a second back section configured to extend a third distance over a portion of the back side of the first board or panel; and a seam section with a front edge attached to the front section and a back edge attached to and between each said back section, said seam section configured to extend through the seam;

wherein the flashing apparatus is attached at a point or points of attachment to the back side of the first board or panel by the second back section, with no penetration of the front side of the first board or panel, and the only holes or penetrations in the flashing apparatus are present in the second back section at said point or points of attachment.

2. The flashing system of claim 1, wherein the first edge has a length, and the flashing apparatus extends for a portion of or all of the length of the first edge.

3. The flashing system of claim 1, wherein the flashing apparatus has two ends, and one or both ends extend beyond the respective ends of the first edge.

4. The flashing system of claim 1, wherein the second distance is greater than the third distance.

5. The flashing system of claim 1, wherein each of the front section, the first back section and the seam section of the flashing apparatus has no holes or penetrations therein.

6. The flashing system of claim 1, wherein the second board or panel is a siding board or siding panel.

7. The flashing system of claim 1, wherein the flashing apparatus comprises a single, contiguous piece.

8. The flashing system of claim 7, wherein the flashing apparatus comprises a piece of folded metal with a thickness, wherein the first back section comprises a folded double thickness portion.

9. The flashing system of claim 1, wherein the flashing apparatus is attached only to the first board or panel.

10. The flashing system of claim 9, wherein the flashing apparatus is adhesively attached to the first edge of the first board or panel.

11. The flashing system of claim 1, wherein the first board or panel is a siding board or siding panel.

12. The flashing system of claim 11, wherein the first board or panel and the second board or panel are arranged horizontally, with the second board or panel above the first board or panel.

* * * * *